United States Patent [19]

Consiglio, Jr.

[11] Patent Number: 4,484,681

[45] Date of Patent: Nov. 27, 1984

[54] PACKAGE FOR CARDED MERCHANDISE

[75] Inventor: Peter A. Consiglio, Jr., Worcester, Mass.

[73] Assignee: Parker Metal Corporation, Worcester, Mass.

[21] Appl. No.: 532,372

[22] Filed: Sep. 15, 1983

[51] Int. Cl.[3] ..... B65D 85/62; B65D 65/26

[52] U.S. Cl. ..... 206/499; 206/45.34; 206/526; 206/606

[58] Field of Search ..... 206/45.34, 526, 499, 206/463, 45.33, 606, 434; 229/40

[56] References Cited

U.S. PATENT DOCUMENTS

| | | | |
|---|---|---|---|
| 2,767,832 | 10/1956 | Silberman | 206/45.33 |
| 3,187,889 | 6/1965 | Sinclair | 206/499 |
| 3,313,407 | 4/1967 | Palm, Jr. | 206/526 |
| 3,454,157 | 7/1969 | Kulig | 206/499 |
| 3,469,680 | 9/1969 | Walz | 206/45.33 |
| 3,721,339 | 3/1973 | Seyer | 206/463 |
| 3,952,872 | 4/1976 | Consiglio, Jr. | 206/526 |

*Primary Examiner*—William T. Dixson, Jr.
*Attorney, Agent, or Firm*—Joseph S. Iandiorio

[57] ABSTRACT

An improved package for carded merchandise includes a collapsible box having first and second opposing side walls, a bottom wall extending between the first and second side walls and attached thereto at first and second fold lines; a top wall is connected to the first side wall along a third fold line and the top wall is attached to the second side wall. There is also a releasable interconnection device for interconnecting the top wall and the second wall.

10 Claims, 8 Drawing Figures

PACKAGE FOR CARDED MERCHANDISE

FIELD OF INVENTION

This invention relates to an improved package for storing, shipping, pricing and displaying for sale goods sold in blisterpack display cards or similar forms.

BACKGROUND OF INVENTION

Packaging is an essential part of many products. It figures greatly in the cost of products and is of primary importance in the promotion and appeal of products which to a large extent determines sales. For example, because of high interest rates, taxes on inventory and the cost of storing and monitoring inventory, retailers seek to reduce to a minimum their inventory in items. In hardware products, wholesalers are finding it more difficult to sell to retailers packages containing ten blisterpack display cards. Retailers do not want more than ten blisterpack display cards. When the remaining quantity on their shelves drops to five they don't want to have to take ten more for a total of fifteen. They prefer to order no more than five. The present packages used for ten blisterpack display cards are too expensive to use for only five blisterpack display cards and are not adapted for easily mounting the blisterpack display cards on the shelf hooks: the box has to have its cover rotated outwardly to access the cards and the hook has to be removed from the wall for insertion into the cards, U.S. Pat. No. 3,952,872. There must be room above and alongside the display area to permit this to be done. In addition, each box must be printed with the promotional identification, trademarks, names and product information. Some packages nest the blisterpack cards to minimize volume but then all of them have to be unpacked for pricing by the wholesalers and then repackaged for shipment to the retailers. This pricing task performed by wholesalers or "feeders", is an essential part of the service they provide to attract and hold large retail chain store customers.

SUMMARY OF INVENTION

It is therefore an object of this invention to provide an improved, simple and inexpensive package for blisterpack display cards.

It is a further object of this invention to provide such a package which securely holds the cards during storage and shipment.

It is a further object of this invention to provide such a package which easily opens to facilitate fast and convenient pricing of the individual cards.

It is a further object of this invention to provide such a package which is easily reclosable to secure the cards in the package during storage and shipment after pricing.

It is a further object of this invention to provide such a package which is easily opened and removed from the cards in position on a hook on a display shelf.

It is a further object of this invention to provide such a package which requires no printing on the package but permits the printing on the cards to be visible to identify and advertise the contents of the package.

This invention features an improved package for carded merchandise. It includes a collapsible box having first and second opposing side walls, a bottom wall extending between the first and second side walls and attached to them at first and second fold lines. A top wall is connected to the first side wall on the third fold line, and there are means for attaching the top wall to the second side wall. There are also means for releasably interconnecting the top wall and the second wall.

In a preferred embodiment, the front and back of the box is substantially open except for first and second retainer tabs interconnected at fourth and fifth fold lines with the back edge of the respective side walls. The sixth fold is disposed on the first side wall parallel to the third fold line for enabling both the top wall and the upper portion of the first side wall to be swung away from the box. The means for releasably interconnecting may include a tab portion carried by one of the top walls and the side wall and slot means carried by the other. The tab means typically is carried by the second side wall and the slot means is disposed in the top wall. The means for attaching may include an attaching flap on the top edge of the second side wall and an attaching area of a top wall for engaging with it. The means for attaching may include adhesive means for securing the top wall and the second side wall. There is a transparent wrapper surrounding the box and the wrapper includes a means for separating its upper portion from its lower portion.

DISCLOSURE OF PREFERRED EMBODIMENT

Other objects, features and advantages will occur from the following description of a preferred embodiment and the accompanying drawings, in which.

The invention may be accomplished with an improved package for carded merchandise which includes a box having first and second opposing side walls, a bottom wall extending between the first and second side walls and attached to them at first and second fold lines. There is a top wall connected to the first side wall along a third fold line and means for attaching the top wall to the second side wall. The means for attaching may include an attaching flap on the top edge of the second side wall and an attaching area on the top wall for engaging with the attaching flap. Some adhesive means are used to secure the attaching flap and the attaching area together.

There are in addition some means for releasably interconnecting the top wall and the second wall which typically may be a tab on the side wall or the top wall with a corresponding slot on the other. For example, the tab could be carried by the attaching flap on the top edge of the second side wall with the slot provided in the top wall beyond the attaching area. The attaching means may be provided as a fourth fold line symmetrically arranged to form a rectangular box with respect to the first, second and third fold lines. Alternatively, the attaching means may be located well into the side wall so that the upper portion of the side wall is actually formed with the top wall, or the attaching means may be formed in the top wall so that the portion of the top wall forms a part of the second side wall. The box, with the display cards inside, is wrapped in a transparent wrapper. The wrapper may be wholly transparent or only partially transparent in the area of the front of the display cards, so that the contents of the box can be easily determined. A tear strip which circumscribes the wrapper about the box may be used to separate the upper part of the wrapper from the lower part. The removal of the upper portion of the wrapper allows the top wall to be separated from the second side wall so that the merchandise cards can be priced while still in the box. The retention of the lower portion of the wrapper holds the box together about the merchandise cards while the pricing is being done. After pricing is complete, the tab and slot or other means for releasably interconnecting, may be engaged to once again secure the box for further shipment and storage. A fold line is provided on the first side wall, spaced from its junction with the top wall to enable that portion of the side wall to swing out away from the merchandise cards along with the top wall, for greater accessibility in pricing. Retainer flaps may be provided in the back opening.

Figure 1:
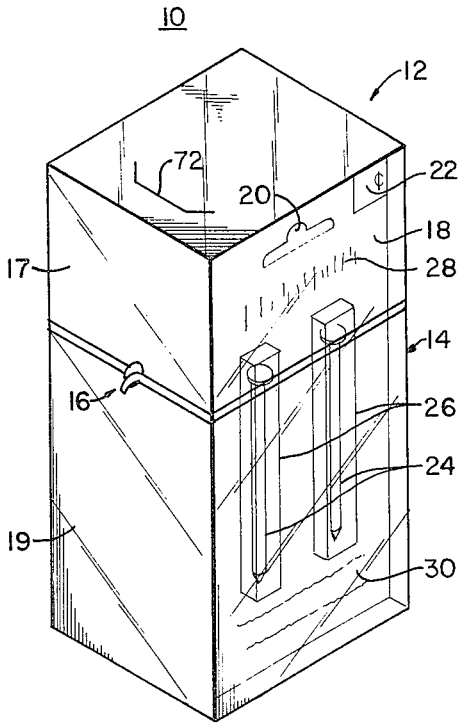
FIG. 1 is an axonometric view of an improved package for carded merchandise including a box and a transparent wrapper with the carded merchandise in place in the package.

There is shown in FIG. 1 an improved package 10 for carded merchandise, including box 12 and a transparent wrapper 14 with a tear strip 16. In use, tear strip 16 is used to separate the upper portion 17 from the lower portion 19 of wrapper 14. Within package 10 are five (5) merchandise cards 18, which include a hole 20 for receiving a shelf hanger, an area 22 to receive the price, and one or more items 24 being offered for sale such as screws, turnbuckles, handles or the like, typically housed in blisterpacks 26. The card also contains written information included at various places 28, 30 on card 18, which gives the size, weight, color, material, product name, brand name and the like, all of which is visible through the transparent wrapper 14.

Figure 2A:
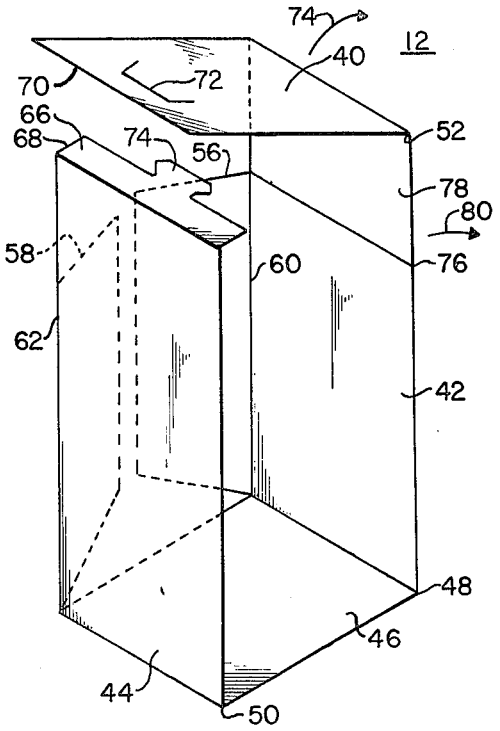
FIG. 2A is an axonometric view of the box of FIG. 1 with its top wall separated and swung away from its associated side wall and the carded merchandise removed for clarity.
Figure 2B:
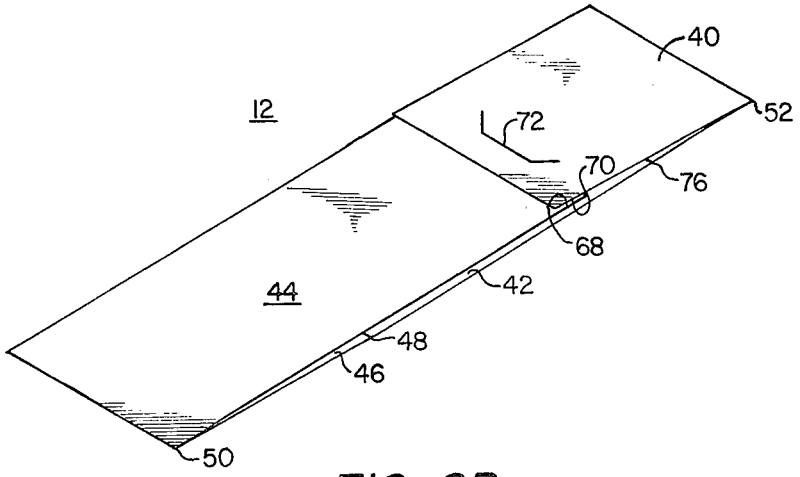
FIG. 2B is an axonometric view of the box of FIG. 2A in a collapsed condition.

Box 12 includes a top wall 40, FIG. 2A, a first side wall 42, a second side wall 44, and bottom wall 46. Bottom wall 46 is connected with first side wall 42 along a first fold line 48 and with second side wall 44 along a second fold line 50. Top wall 40 is joined at a third fold line 52 with first side wall 42. In the embodiment of FIG. 2A the front area of box 12 is completely open. The back area is also open except for two retaining tabs 56, 58, which are attached along fourth and fifth fold lines 60, 62 to first and second side walls 42 and 44, respectively. Initially, top wall 40 is attached to the upper end of second wall 44 by an adhesive 66 on attaching flap portion 68 which engages with an attaching area 70 on a corresponding underside of top wall 40. When the initial attachment has been broken to allow top wall 40 to be swung away from second side wall 44, the top wall 40 may be nevertheless later reconnected by means of slot 72 on top wall 40 and tab 74 at the top of side wall 44 extending from attachment flap 68. When in the freed condition, as shown in FIG. 2A, top wall 40 may be swung outwardly as indicated by arrow 74. In addition, a fold line 76 on first side wall 42 permits the upper portion 78 of side wall 42 to be swung outwardly as indicated by arrow 80 to make even more accessible the merchandising cards contained in box 12. Box 12 is shown in a collapsed condition with retainer tabs 62 and 60 folded inside in FIG. 2B.

Figure 3:
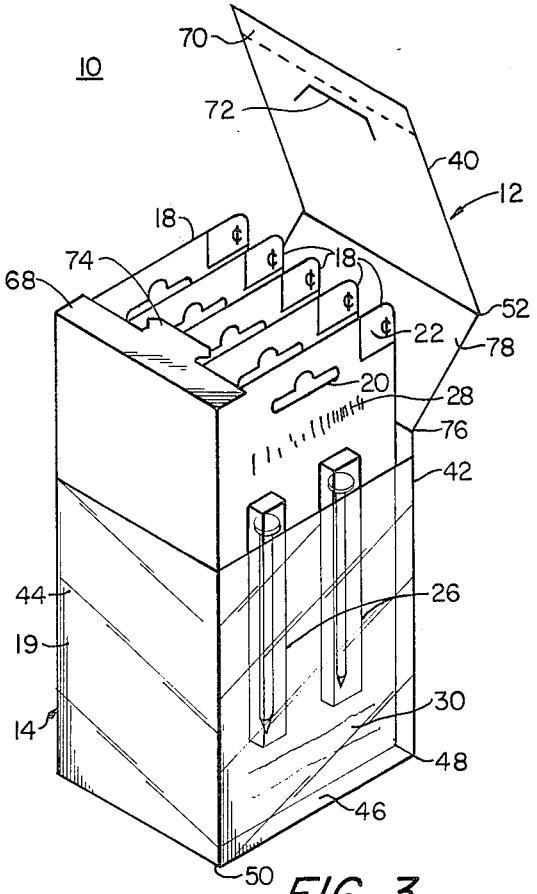
FIG. 3 is a view similar to FIG. 1, with the upper portion of the transparent wrapper moved and the top wall opened in preparation for pricing.
Figure 4:
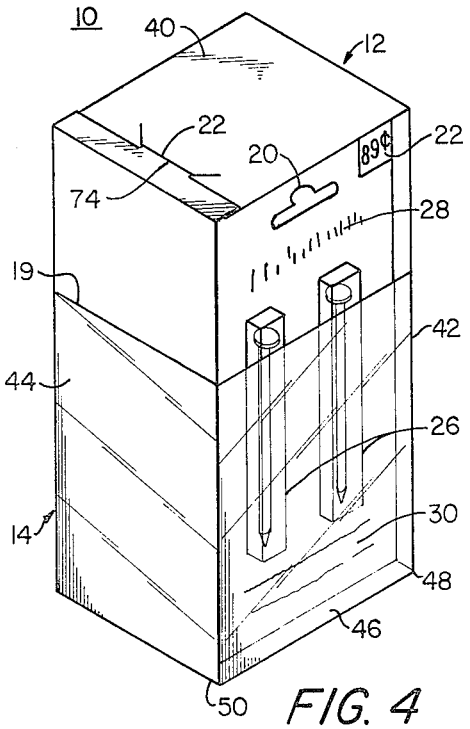
FIG. 4 is a view similar to FIGS. 1 and 3, with the top wall reconnected with the side wall after pricing.

In use, tear strip 16 is used to separate the upper portion 17 from the lower portion 19 of wrapper 14. With upper portion 17 of the wrapper removed, top wall 40 may have its attaching area 70 separated from attaching flap 68 of second side wall 44 and swung back along with the upper portion 78 of first wall 42 to provide easy access to the five merchandising cards 18, so that they may be rapidly priced. After pricing is complete, by the placing of the price in the pricing area 22, FIG. 4, top wall 40 is swung back into place. This time the attaching area 68 is swung on top of top wall 40, so that tab 74 is inserted in slot 72 and the box is once again secure for shipment and storage. During the pricing operation, when box 12 is in the open condition as shown in FIG. 3, the lower portion 19 of the wrapper functions to hold the box and the merchandise cards together as a unit.

Figure 5:
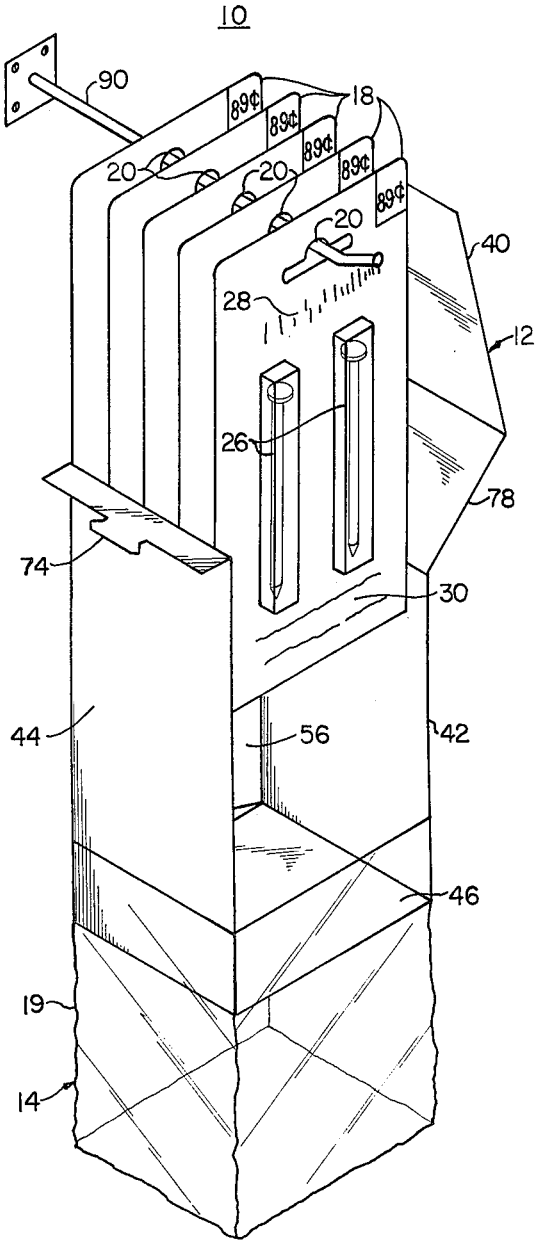
FIG. 5 is a view similar to FIGS. 1, 3 and 4, with the box opened and in the process of being slipped down away from the display cards which have been impaled on a hanger hook.
Figure 6:
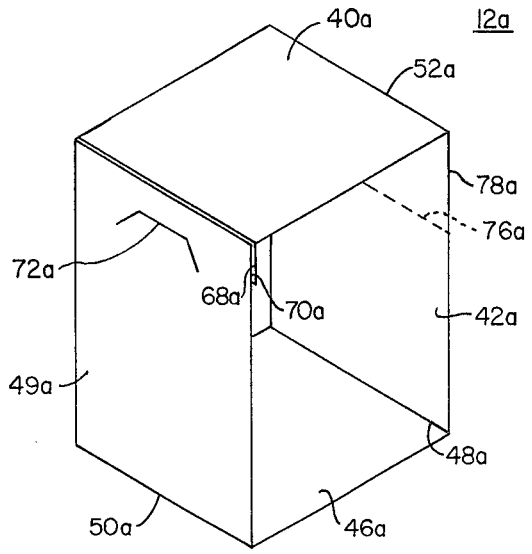
FIG. 6 is an axonometric view of an alternative construction of the box of FIG. 2 in which the tab is carried by the top wall and the slot is carried by the side wall.

When package 10 reaches a retail store, it may be quickly and easily mounted on a shelf hook 90 by placing the openings 20 in display cards 18 over shelf hook 90, FIG. 5, which is easily accomplished since the upper portion 17 of wrapper 14 has been removed and there is nothing to impede the movement of hook 90 through package 10. With tab 74 removed from slot 72, top wall 40 and the upper portion 78 of first wall 42 are easily swung away so that box 12 can be conveniently slid downwardly and/or directly outwardly without disturbing the rest of the merchandise on the rack. The lower portion 19 of wrapper 14 at this point may be removed or not, as necessary.

Figure 7:
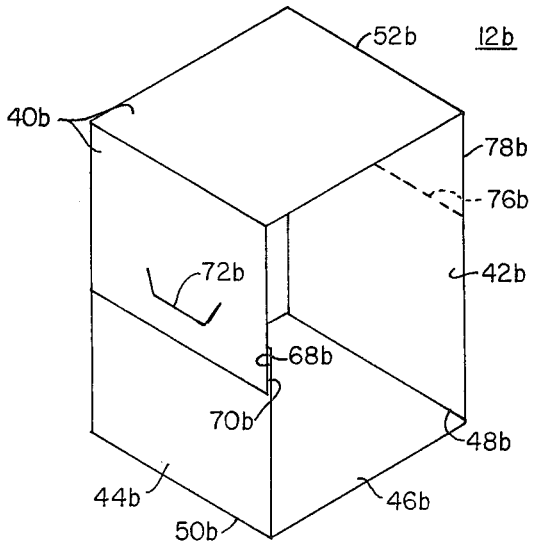
FIG. 7 is an axonometric view of another construction of the box of FIG. 2 in which the top wall is extended to form the upper portion of the side wall.

Although throughout FIGS. 1–5 the attaching flap and tab have been on the second side wall while the slot has been on the top wall, this is not a necessary limitation of the invention. For example, in box **12*a*, FIG. 6, slot 72*a* may be on the upper portion of slide wall 44*a* along with the attaching area 70*a*, while the attaching flap 60*a* with the tab, not shown, may be carried by top wall 40*a*. Alternatively, the means for attaching and means for releasably interconnecting may, instead of being at a fold line as shown in FIGS. 1–6, be disposed wholly within top wall 40 or side wall 44, FIG. 7, where the attaching area of side wall 44*b* meets with attaching area of 70*b* of top wall 40*b* midway down the left side of box 12*b*. In this condition, the integral portion formed from the top and the upper portion of the side wall are referred to as top wall 40*b*, while the second side wall 44*b*** becomes just the lower portion of that side.

Other embodiments will occur to those skilled in the art and are within the following claims:

What is claimed is:

1. An improved package for carded merchandise comprising: a collapsible box including generally vertical first and second opposing side walls, a bottom wall extending between said first and second side walls and attached directly thereto at first and second fold lines, a top wall connected directly to said first side wall along a third fold line, means for attaching said top wall to said second side wall, means for releasably interconnecting said top wall and said second wall, and an open front.

2. The improved package of claim 1 in which the back of the box is substantially open except for first and second retainer tabs interconnected at fourth and fifth fold lines with the back edge of the respective side walls.

3. The improved package of claim 1 in which a sixth fold is disposed on said first side wall parallel to said third fold line for enabling both said top wall and the upper portion of said first side wall to be swung away from the box.

4. The improved package of claim 1 in which said means for releasably interconnecting includes a tab portion carried by one of said top wall and said second side wall and slot means carried by the other.

5. The improved package of claim 4 in which said tab is carried by said second side wall and said slot means is disposed in said top wall.

6. The improved package of claim 1 in which said means for attaching includes an attaching flap on the top edge of said second side wall and an attaching area on said top wall for engaging therewith.

7. The improved package of claim 6 in which said means for releasibly interconnecting includes a tab portion carried by said attaching flap and slot means carried by said top wall.

8. The improved package of claim 1 in which said means for attaching includes adhesive means for securing said top wall and said side wall.

9. The improved package of claim 1, further including a transparent wrapper surrounding said box.

10. The improved package of claim 9 in which said wrapper includes means for separating its upper portion from its lower portion.

* * * * *